US009767747B2

(12) United States Patent
Oh et al.

(10) Patent No.: US 9,767,747 B2
(45) Date of Patent: Sep. 19, 2017

(54) DISPLAY DEVICE AND METHOD OF DRIVING THE SAME

(71) Applicant: LG Display Co., Ltd., Seoul (KR)

(72) Inventors: Daeseok Oh, Paju-si (KR); Sangsoon Yoon, Paju-si (KR); Yonghwa Park, Paju-si (KR); Seunghwan Shin, Suncheon-si (KR); Moonsoo Chung, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 163 days.

(21) Appl. No.: 14/750,987

(22) Filed: Jun. 25, 2015

(65) Prior Publication Data

US 2016/0035297 A1 Feb. 4, 2016

(30) Foreign Application Priority Data

Jul. 29, 2014 (KR) ..... 10-2014-0096834

(51) Int. Cl.

| | |
|---|---|
| ***G09G 3/36*** | (2006.01) |
| ***G09G 5/00*** | (2006.01) |
| ***G09G 3/20*** | (2006.01) |

(52) U.S. Cl.

CPC ..... *G09G 3/3618* (2013.01); *G09G 3/2092* (2013.01); *G09G 3/2096* (2013.01); *G09G 5/006* (2013.01); *G09G 2310/061* (2013.01); *G09G 2310/08* (2013.01); *G09G 2320/103* (2013.01); *G09G 2330/021* (2013.01); *G09G 2340/0435* (2013.01)

(58) Field of Classification Search

CPC ..... G09G 2310/08; G09G 3/3233; G09G 2300/0426; G09G 3/3258; G09G 2330/021; G09G 3/3696; G09G 3/20

See application file for complete search history.

(56) References Cited

U.S. PATENT DOCUMENTS

| | | | | |
|---|---|---|---|---|
| 2008/0079739 | A1* | 4/2008 | Gupta | G09G 5/363 345/520 |
| 2008/0170023 | A1* | 7/2008 | Choi | G02F 1/133784 345/96 |
| 2013/0021352 | A1* | 1/2013 | Wyatt | G09G 5/395 345/520 |

(Continued)

FOREIGN PATENT DOCUMENTS

| | | | |
|---|---|---|---|
| CN | 102543023 | A | 7/2012 |
| CN | 102841671 | A | 12/2012 |
| TW | 201335910 | A1 | 9/2013 |

OTHER PUBLICATIONS

Chinese First Office Action, Chinese Application No. 201510456035.0, dated May 4, 2017, 21 pages.

*Primary Examiner* — Olga Merkoulova

(74) *Attorney, Agent, or Firm* — Fenwick & West LLP

(57) ABSTRACT

A display device and method of driving the same are disclosed. The display device that transmits signals between a system board section and a circuit board section through an interface and uses Panel Self-Refresh (hereinafter, abbreviated as 'PSR') to reduce power consumption, the circuit board section comprising a PSR controller that, when a PSR On signal is supplied from the system board section, changes the operating frequency of a gate driver and data driver to a frequency higher than a reference frequency for driving the panel with PSR On, set by the system board section.

17 Claims, 14 Drawing Sheets

(56) References Cited

U.S. PATENT DOCUMENTS

2013/0187937 A1* 7/2013 Kerofsky ..... G09G 3/20
345/530
2013/0278614 A1* 10/2013 Sultenfuss ..... G09G 3/3406
345/520

* cited by examiner (a)

(b)

DISPLAY DEVICE AND METHOD OF DRIVING THE SAME

This application claims the benefit of Korean Patent Application No. 10-2014-0096834, filed on Jul. 29, 2014, which is incorporated herein by reference for all purposes as if fully set forth herein.

BACKGROUND

Field

This document relates to a display device and a method of driving the same.

Related Art

With the development of information technology, the market for display devices (i.e., media connecting users and information) is growing. In line with this trend, the use of display devices, such as organic light emitting displays (OLEDs), liquid crystal displays (LCDs), flat panel displays (FPDs), etc., is increasing.

Some of the aforementioned display devices, for example, a liquid crystal display or an organic light emitting display, include a display panel including a plurality of subpixels arranged in a matrix form and a drive part that drives the display panel. The drive part includes a gate driver for supplying a gate signal (or scan signal) to the display panel and a data driver for supplying a data signal to the display panel.

When a scan signal, data signal, etc. are supplied to subpixels arranged in a matrix form, a display device such as a liquid crystal display or an organic light emitting display is able to display an image by allowing selected subpixels to emit light.

When a data signal for a static image is supplied, a display device such as a liquid crystal display or an organic light emitting display is driven in Panel Self-Refresh (hereinafter, abbreviated as 'PSR') mode to reduce power consumption.

PSR is a technology that was suggested to save system power on display devices and extend battery life in mobile application environments. The PSR technology can significantly increase battery uptime in mobile application environments with the use of a memory embedded in a display device because it can minimize power consumption and display images as normal.

The PSR technology, when a data signal for a static image is supplied, allows the panel to run at as low as 48 Hz, which is the lowest frequency possible at which no flicker is seen. However, the conventional PSR technology has the problem of perceivable changes in brightness that are caused by increased data voltage charging time when PSR is switched from off (Liquid Crystal Display Module, hereinafter, abbreviated as "LCM", LCM runs at 60 Hz) to on (LCM runs at 48 Hz), which needs to be improved.

SUMMARY

An aspect of this document is to provide a display device that transmits signals between a system board section and a circuit board section through an interface and uses Panel Self-Refresh (hereinafter, abbreviated as 'PSR') to reduce power consumption. The circuit board section comprises a PSR controller that, when a PSR On signal is supplied from the system board section, changes the operating frequency of a gate driver and data driver to a frequency higher than a reference frequency for driving the panel with PSR On, set by the system board section.

In another aspect, there is provided a method of driving a display device that transmits signals between a system board section and a circuit board section through an interface and uses PSR to reduce power consumption. The method comprises: when a PSR On signal is supplied from the system board section, changing the operating frequency of a gate driver and data driver to a frequency higher than a reference frequency for driving the panel with PSR On, set by the system board section; leaving the remaining time a blank period, out of 1 frame period, as the operating frequency of the gate driver and data driver is changed to a frequency higher than the reference frequency; and temporarily stopping the data driver during a period of time corresponding to the sum of a vertical blanking interval and the blank period.

In another aspect, there is provided a display device that transmits signals between a system board section and a circuit board section through an interface and uses PSR to reduce power consumption. The circuit board section comprises a PSR controller that, when a PSR On signal is supplied from the system board section, changes the operating frequency of a gate driver and data driver to a frequency of i Hz (i is an integer equal to or higher than 1) and a frequency of k Hz (k is an integer equal to or higher than 60), and inserts a compensation frequency of j Hz (j is an integer higher than i and lower than k) into a transition period situated between the i Hz frequency and the k Hz frequency.

BRIEF DESCRIPTION OF THE DRAWINGS

The implementation of this document will be described in detail with reference to the following drawings in which like numerals refer to like elements.

DETAILED DESCRIPTION

Reference will now be made in detail to embodiments of the invention, examples of which are illustrated in the accompanying drawings.

Hereinafter, specific exemplary embodiments of the present invention will be described in detail with reference to the attached drawings.

First Exemplary Embodiment

Figure 1:
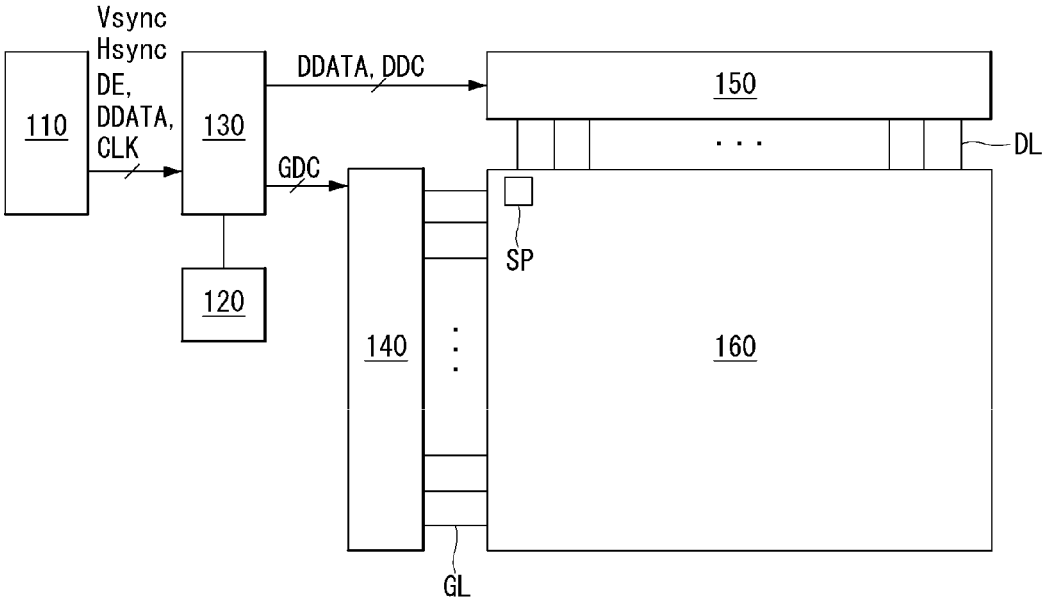
FIG. 1 is a view schematically showing a part of a display device according to a first exemplary embodiment of the present invention.
Figure 2:
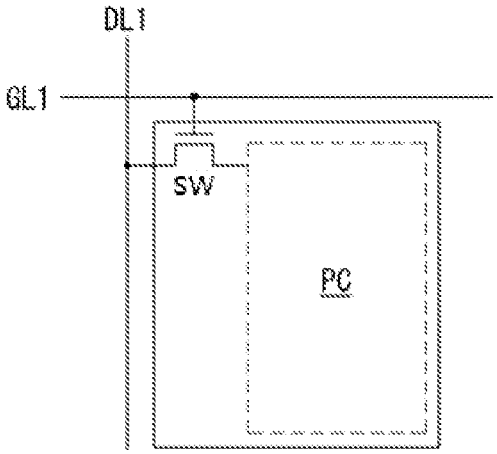
FIG. 2 is a schematic circuit diagram of a subpixel shown in FIG. 1.
Figure 3:
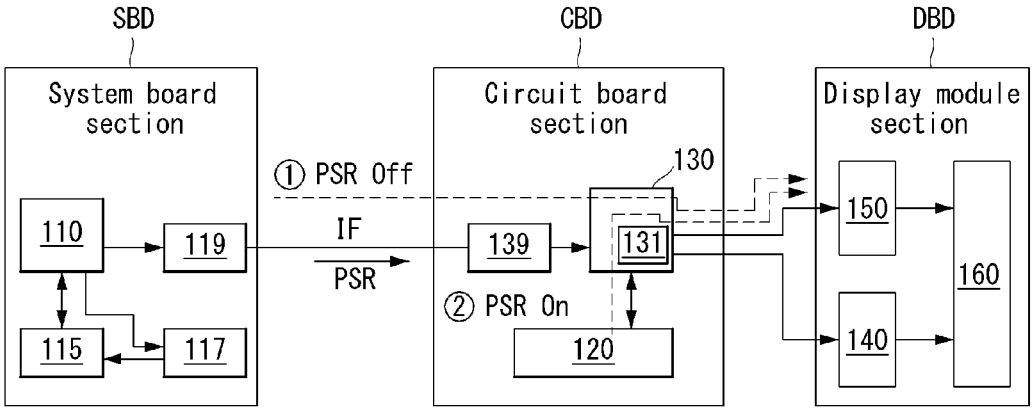
FIG. 3 is a view showing a part of the display device according to the first exemplary embodiment of the present invention, divided by sections.
Figure 4:
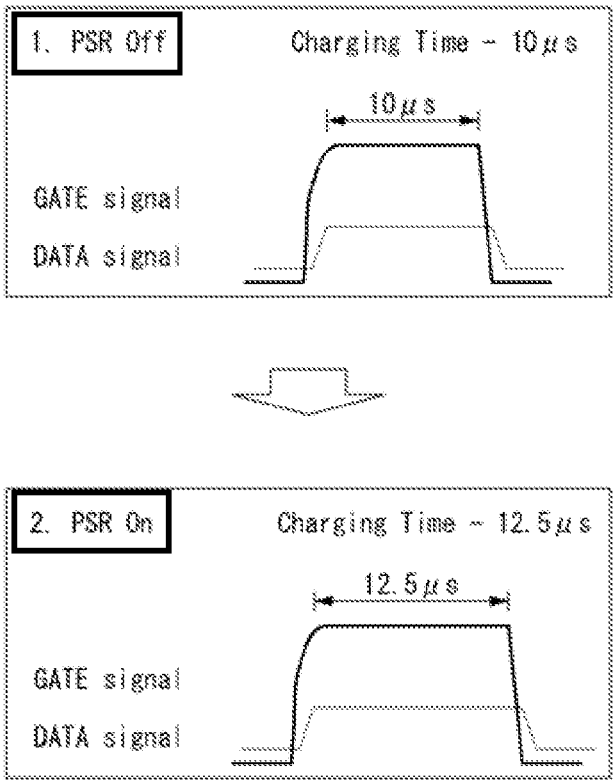
FIG. 4 is a waveform diagram for explaining a problem with PSR mode according to a comparative example.

FIG. 1 is a view schematically showing a part of a display device according to a first exemplary embodiment of the present invention. FIG. 2 is a schematic circuit diagram of a subpixel shown in FIG. 1. FIG. 3 is a view showing a part of the display device according to the first exemplary embodiment of the present invention, divided by sections. FIG. 4 is a waveform diagram for explaining a problem with PSR mode according to a comparative example.

As shown in FIGS. 1 to 3, the display device according to the first exemplary embodiment of the present invention comprises a system board section SBD, a circuit board section CBD, and a display module section DBD.

The system board section SBD comprises an image processor 110, a frame memory 115, a frame memory controller 117, and an eDP transmitter 119.

The image processor 110 generates a vertical synchronization signal Vsync, horizontal synchronization signal Hsync, data enable signal DE, clock signal CLK, etc. The image processor 110 outputs the vertical synchronization signal Vsync, horizontal synchronization signal Hsync, data enable signal DE, clock signal CLK, etc., together with a data signal DDATA supplied from the frame memory 115.

The frame memory 115 stores an externally supplied data signal DDATA in a frame and supplies the stored data signal DDATA in a frame to the image processor 110.

The frame memory controller 117 controls the frame memory 115. The frame memory controller 117 operates in conjunction with the image processor 110 and supplies the data signal DDATA stored in the frame memory 115 to the image processor 110.

The eDP transmitter 119, an embedded display port, is an interface (IF) for a display port (DP) developed by the Video Electronics Standards Association (VESA). The eDP transmitter 119 serves to transmit various signals generated by the system board section SBD to the circuit board section CBD.

The circuit board section CBD comprises an eDP receiver 139, a remote frame memory 120, and a timing controller 130.

The eDP receiver 139 is an interface (IF) consisting of an embedded display port like the eDP transmitter 119. The eDP receiver 139 serves to receive various signals sent from the eDP transmitter 119 and transmit various signals to the circuit board section CBD.

The remote frame memory 120 is an integrated device of a frame memory and a controller for controlling the frame memory. The remote frame memory 120 temporarily stores a data signal DDATA sent from the system board section SBD, and supplies the stored data signal DDATA to the timing controller 130.

The timing controller 130 receives from the eDP receiver 139 a vertical synchronization signal Vsync, horizontal synchronization signal Hsync, data enable signal DE, clock signal CLK, and data signal DDATA. The timing controller 130 controls the operation timings of the data driver 150 and gate driver 140 by using timing signals such as the synchronization signal Vsync, horizontal synchronization signal Hsync, data enable signal DE, clock signal CLK, and data signal DDATA.

As the timing controller 130 may determine a frame period by counting data enable signals DE of 1 horizontal period, the vertical synchronization signal and the horizontal synchronizations signal supplied from the outside can be omitted. Control signals generated by the timing controller 130 comprise a gate timing control signal GDC for controlling the operation timing of the gate driver 140 and a data timing control signal DDC for controlling the operation timing of the data driver 150.

The gate timing control signal GDC comprises a gate start pulse, gate shift clock, gate output enable signal, etc. The data timing control signal DDC comprises a source sampling clock, polarity control signal, source output enable signal, etc.

The display module section DBD comprises a display panel 160, a data driver 150, and a gate driver 140.

The data driver 150 samples and latches a digital data signal DDATA supplied from the timing controller 130 and converts it into data for parallel data systems, in response to a data timing control signal DDC supplied from the timing controller 130. The data driver 150 converts the digital data signal DDATA into an analog data signal ADATA corresponding to a gamma grayscale voltage. The data driver 150 supplies the converted data signal ADATA to subpixels SP included in the display panel 160 through data lines DL1 to DLn.

The gate driver 140 sequentially generates a gate signal (gate-high voltage), in response to the gate timing control signal GDC supplied from the timing controller 110, while shifting the signal level a swing width of a gate driving voltage at which the transistors of the subpixels SP in the display panel 160 can operate. The gate driver 140 supplies the generated gate signal to the subpixels SP included in the display panel 160 through gate lines GL1 to GLm.

The display panel 160 display an image in response to the gate signal output from the gate driver 140 and the data signal ADATA output from the data driver 150. The display panel 160 comprises the subpixels SP situated between a lower substrate and an upper substrate. The subpixels SP operate in response to the gate signal and data signal ADATA.

One subpixel comprises a switching transistor SW connected to a gate line GL1 and a data line DL1 and a pixel circuit PC that operates in response a data signal ADATA supplied through the switching transistor SW. The subpixels SP constitute a liquid crystal display panel comprising liquid crystal elements or an organic light emitting display panel comprising organic light emitting diodes, depending on the configuration of the pixel circuit PC.

If the display panel 160 is a liquid crystal display panel, each subpixel SP comprises a switching thin film transistor SW, a storage capacitor, a pixel electrode, a common electrode, a liquid crystal layer, a color filter, a black matrix, etc.

In this case, when a gate signal and a data signal are supplied from the gate driver 140 and the data driver 150, the switching thin film transistor SW is driven so that a data voltage is stored in the storage capacitor of each subpixel SP. Afterwards, the data voltage is supplied to the pixel electrode and a common voltage is supplied to the common electrode, and the liquid crystal is tilted by an electric field formed between the pixel electrode and the common electrode. In the above process, the transmittance of light coming from the backlight unit is controlled by the liquid crystal layer, thereby allowing the liquid crystal display panel to display an image.

The display panel 160, if configured as a liquid crystal display panel, is implemented in TN (Twisted Nematic) mode, VA (Vertical Alignment) mode, IPS (In-Plane Switching) mode, FFS (Fringe Field Switching) mode, or FCB (Electrically Controlled Birefringence) mode.

If the display panel 160 is an organic light emitting display panel, each subpixel SP comprises a switching thin film transistor SW, a driving thin film transistor, a capacitor, an organic light emitting diode, etc.

In this case, when a gate signal and a data signal are supplied from the gate driver 140 and the data driver 150, the switching thin film transistor SW is driven so that a data voltage is stored in the capacitor of each subpixel SP. Afterwards, the driving thin film transistor is driven by the data voltage, causing a driving current to flow to the anode and cathode of the organic light emitting diode. In the above process, the amount of light is controlled by the driving current flowing through the organic light emitting diode, thereby allowing the organic light emitting display panel to display an image.

The display panel 160, if configured as an organic light emitting display panel, may be a top-emission type, bottom-emission type, or dual-emission type.

Meanwhile, the display device comprising the eDP transmitter 119 and the eDP receiver 139 supports the Panel Self-Refresh (hereinafter, abbreviated as 'PSR') according to the eDP standard. PSR is a technology that was suggested to save system power on display devices and extend battery life in mobile application environments.

The PSR technology can significantly increase battery uptime in mobile application environments with the use of a memory embedded in a display device because it can minimize power consumption and display images as normal. The PSR technology, when a data signal for a static image is supplied, allows the panel to run at as low as 48 Hz, which is the lowest frequency possible at which no flicker is seen.

However, as shown in FIG. 4, the conventional PSR technology has the problem of perceivable changes in brightness caused by increased data voltage charging time.

Specifically, when PSR is turned on/off, the gate start pulse GSP, gate shift clock GSC, gate output enable signal GOE, and source output enable signal SOE that control the gate signal and the data signal change with an internal data enable signal NDE generated by the timing controller.

Therefore, a transition of PSR from off (Liquid Crystal Display Module, hereinafter, abbreviated as "LCM", LCM runs at 60 Hz) to on (LCM runs at 48 Hz) creates a frequency difference of approximately 25%, causing an increase in data voltage charging time when the frequency changes. As a result, a change in brightness can be perceived.

Accordingly, the first exemplary embodiment of the present invention provides a PSR controller 131 within the timing controller 130 to improve the problem of perceivable changes in brightness made to the display module section DBD during the use of PSR. A description of this will be given in detail below.

Figure 5:
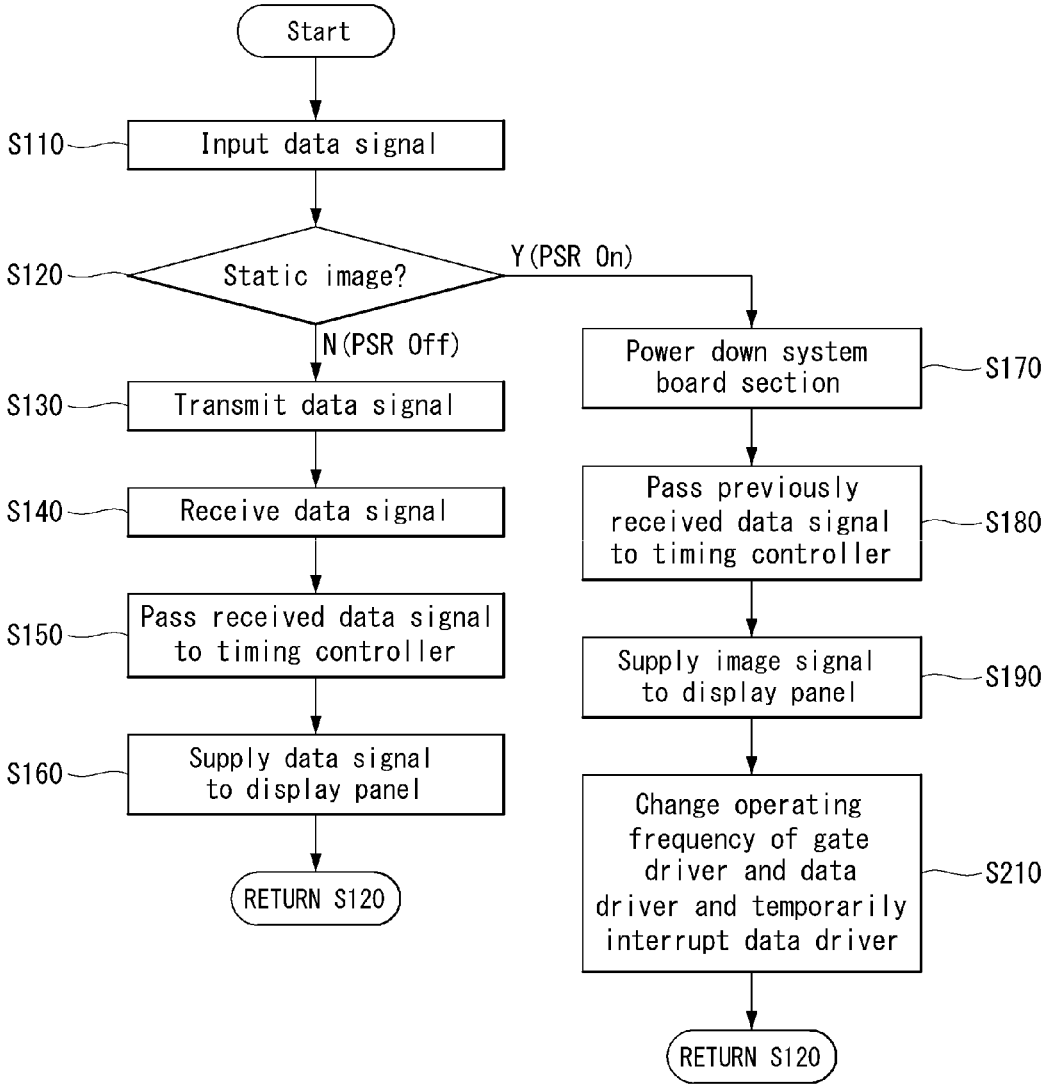
FIG. 5 is a flowchart for explaining a PSR scheme according to the first exemplary embodiment of the present invention.

FIG. 5 is a flowchart for explaining a PSR scheme according to the first exemplary embodiment of the present invention.

As shown in FIGS. 1 to 5, when a data signal DDATA is input into the image processor 110 of the system board section SBD (S110), the image processor 110 of the system board section SBD determines whether the input data signal DDATA is for a static image or a moving image (S120).

The image processor 110 of the system board section SBD may determine in various ways whether the input data signal DDATA is for a static image or a moving image. For example, the image processor 110 of the system board section SBD may compare consecutive input data signals DDATA frame by frame, and if the amount of change in data signal DDATA between neighboring frames is less than a predetermined threshold value, may determine that these data signals DDATA are for a static image. On the contrary, if the amount of change in data signal DDATA between neighboring frames is greater than or equal to the threshold value, the image processor 110 of the system board section SBD may determine that these data signals DDATA are for a moving image.

—Driving the Panel with PSR Turned Off—

If an input data signal DDATA is for a moving image (N), the eDP transmitter 119 of the system board section SBD transmits a PSR Off signal (PSR Off). Accordingly, PSR is disabled. With PSR disabled, the image processor 110 of the system board section SBD reads the data signal DDATA through the frame memory 115 and then transmits it through the eDP transmitter 119 (S130).

Then, the edP receiver 139 of the circuit board section CBD receives the data signal DDATA sent from the eDP transmitter 119 (S140), and passes the received data signal DDATA to the timing controller 130.

The timing controller 130 of the circuit board section CBD supplies the received data signal DDATA to the data driver 150. The data driver 150 then converts the data signal DDATA supplied from the timing controller 130 into an analog data signal ADATA corresponding to a gamma gray-scale voltage, and supplies the analog data signal ADATA to the display panel 160.

—Driving the Panel with PSR Turned on—

If an input data signal DDATA is for a static image (Y), the eDP transmitter 119 of the system board section SBD transmits a PSR On signal (PSR On). Accordingly, PSR is enabled. With PSR enabled, the system board section SBD is powered down (S170). Accordingly, some components of the system board section SBD stop running and go to a sleep state.

When the image processor 110, etc. of the system board section SBD goes to a sleep state, the timing controller 130 of the circuit board section CBS receives the previously received data signal DDATA from the remote frame memory 120 (S180).

The timing controller 130 of the circuit board section CBD supplies the data signal DDATA coming from the remote frame memory 120 to the data driver 150. The data driver 150 then converts the data signal DDATA supplied from the timing controller 130 into an analog data signal ADATA corresponding to a gamma grayscale voltage, and supplies the analog data signal ADATA to the display panel 160 (S190).

Next, the PSR controller 131 included in the timing controller 130 of the circuit board section CBD changes the operating frequency of the gate driver 140 and data driver 150, and temporarily stops (or interrupts) the data driver 150 only for a specific period (S210).

To use PSR according to the above flow, the PSR controller 131 is configured as follows. The above-explained PSR scheme can be embodied by the configuration and operation of the PSR controller 131 to be described later, so it will be interpreted together with the following description.

Figure 6:
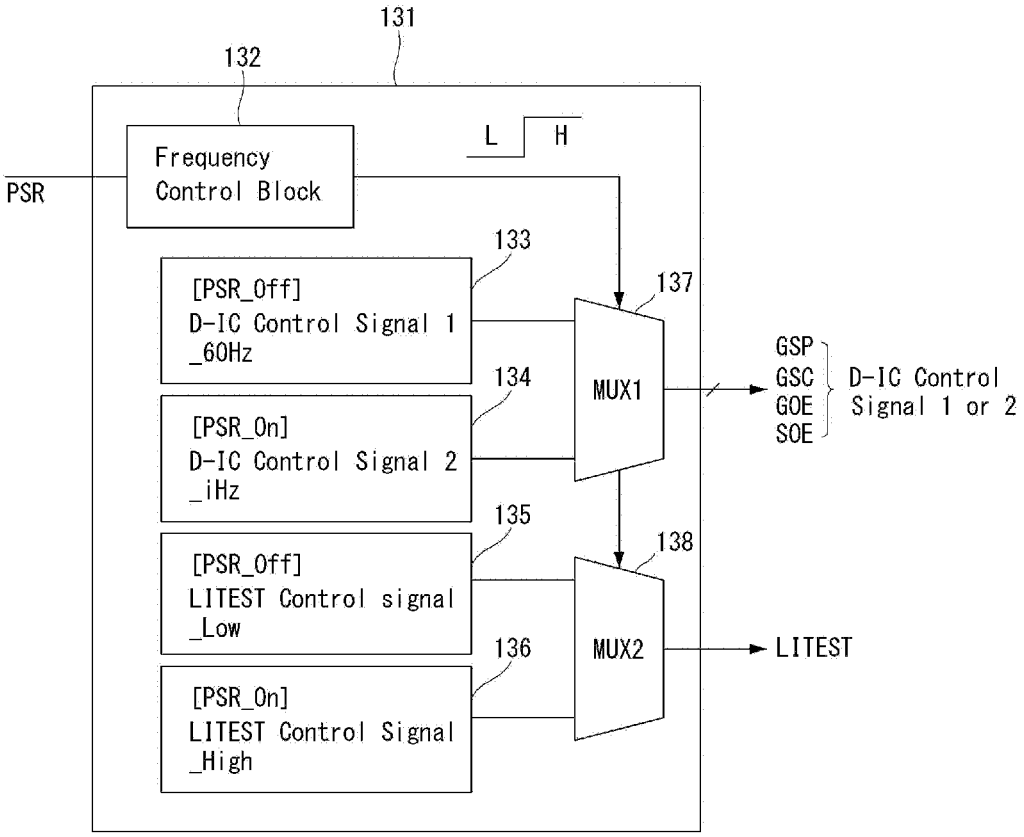
FIG. 6 is a block diagram of a PSR controller according to the first exemplary embodiment of the present invention.
Figure 7:
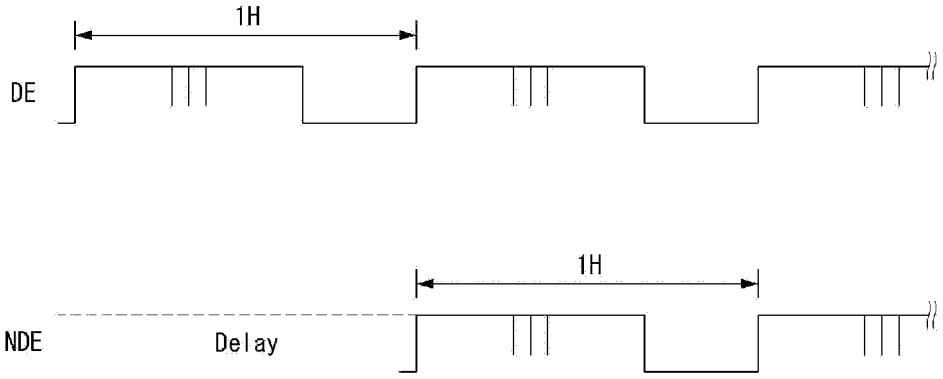
FIG. 7 is a waveform diagram for explaining the generation of an internal data enable signal by a timing controller.
Figure 8:
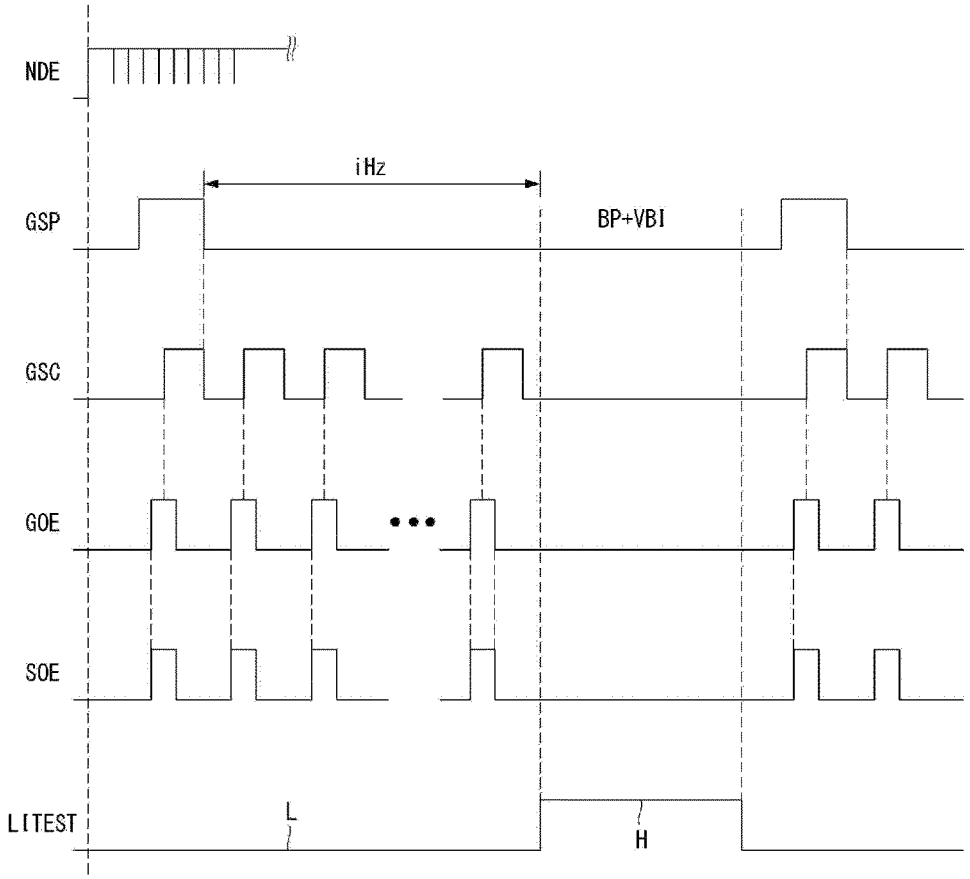
FIG. 8 is a waveform diagram showing changes in control signals made when PSR is turned on according to the first exemplary embodiment of the present invention.
Figure 9:
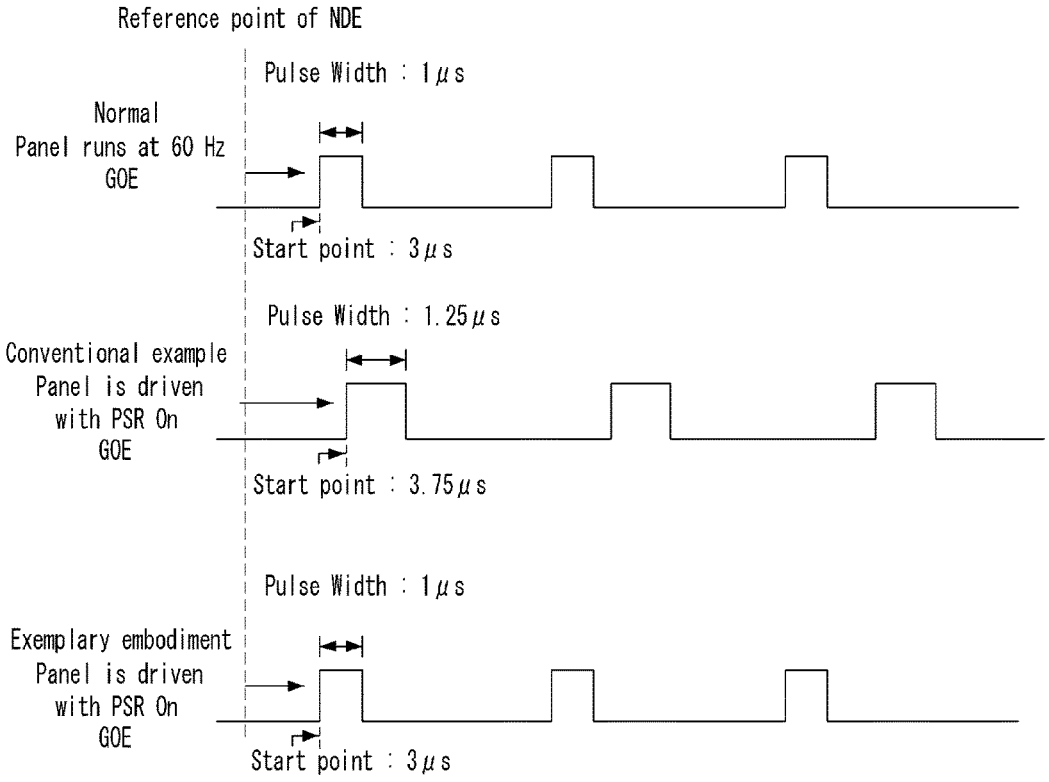
FIG. 9 is a waveform diagram showing changes in gate output enable signal made when PSR is turned on according to the first exemplary embodiment of the present invention.
Figure 10:
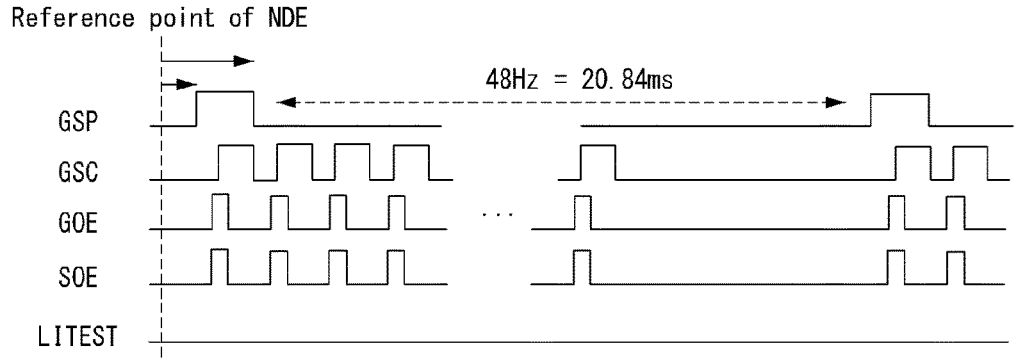
FIG. 10 is a waveform diagram for explaining a frequency change made when PSR is turned on according to the first exemplary embodiment of the present invention.
Figure 10:
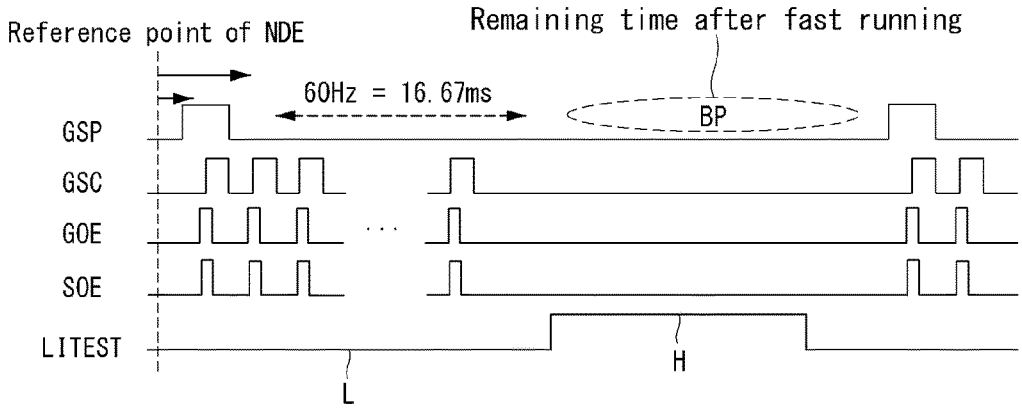

FIG. 6 is a block diagram of a PSR controller according to the first exemplary embodiment of the present invention. FIG. 7 is a waveform diagram for explaining the generation of an internal data enable signal by a timing controller. FIG. 8 is a waveform diagram showing changes in control signals made when PSR is turned on according to the first exemplary embodiment of the present invention. FIG. 9 is a waveform diagram showing changes in gate output enable signal made when PSR is turned on according to the first exemplary embodiment of the present invention. FIG. 10 is a waveform diagram for explaining a frequency change made when PSR is turned on according to the first exemplary embodiment of the present invention.

As shown in FIGS. 6 to 10, the PSR controller 131 outputs a D-IC control signal for changing the operating frequency of the gate driver and data driver and a logic signal LITEST for temporarily stopping the data driver only for a specific period, in association with the turn-on/off of PSR.

The PSR controller 131 comprises a frequency control block 132, a first control signal generator 133, a second control signal generator 134, a low signal generator 135, a high signal generator 136, a first MUX 137, and a second MUX 138.

The frequency control block 132 outputs a selection signal for controlling an operating frequency output from the timing controller, depending on the state of a PSR signal. When a PSR Off signal is supplied, the frequency control block 132 outputs a selection signal of logic low (L) to output a signal associated with the turn-off of PSR. In contrast, when a PSR On signal is supplied, the frequency control block 132 outputs a selection signal of logic high (H) to output a signal associated with the turn-on of PSR.

The first control signal generator 133 generates a first control signal (D-IC control signal 1) for controlling the operating frequency of the gate driver and data driver when PSR is turned off. For example, the first control signal generator 133 generates a gate start pulse GSP, gate shift clock GSC, and gate output enable signal GOE for controlling the operating frequency of the gate driver, and a source output enable signal SOE for controlling the operating frequency of the source driver.

The first control signal (D-IC control signal 1) output from the first control signal generator 133 has a frequency for driving the display panel with PSR Off (or normal mode). For example, if a normal operating frequency for the display panel is represented by k Hz (k is an integer greater than or equal to 60; hereinafter, referred to as 60 Hz), the first control signal generator 133 generates the gate start pulse GSP, gate shift clock GSC, gate output enable signal GOE, and source output enable signal SOE included in the first control signal (D-IC control signal 1), corresponding to 60 Hz.

The second control signal generator 134 generates a second control signal (D-IC control signal 2) for controlling the operating frequency of the gate driver and data driver when PSR is turned on. For example, the second control signal generator 134 generates a gate start pulse GSP, gate shift clock GSC, and gate output enable signal GOE for controlling the operating frequency of the gate driver, and a source output enable signal SOE for controlling the operating frequency of the source driver.

The second control signal (D-IC control signal 2) output from the second control signal generator 134 has a frequency for driving the display panel with PSR On (or power-saving mode). As shown in FIG. 7, the timing controller delays the data enable signal supplied from the image processor by 1 horizontal period (1H) or longer to generate an internal data enable signal NDE. Due to this, the second control signal generator 134 of the PSR controller 131 included in the timing controller generates the second control signal (D-IC control signal 2) based on the internal data enable signal NDE.

As shown in FIG. 8, the second control signal generator 134 changes the second control signal (D-IC control signal 2) based on the internal data enable signal NDE to have a frequency of i Hz (i Hz is a frequency equal to or higher than 48 Hz), higher than a reference frequency for driving the panel with PSR On, set by the system board section.

Specifically, the second control signal generator 134 synchronizes the start point of the internal data enable signal NDE with the start points of the gate start pulse GSP, gate shift clock GSC, gate output enable signal GOE, and source output enable signal SOE included in the second control signal (D-IC control signal 2). Also, the second control signal generator 134 reduces the pulse widths of the gate start pulse GSP, gate shift clock GSC, gate output enable signal GOE, and source output enable signal SOE included in the second control signal (D-IC control signal 2).

For example, as shown in FIG. 9, the conventional scheme for driving the panel with PSR On causes the panel to run at 48 Hz, i.e., the power-saving frequency set by the system board section. In this case, the logic high of the gate output enable signal GOE starts after a delay of 3.75 μs, and the pulse width of the gate output enable signal GOE increase to 1.25 μs. However, as explained with reference to FIG. 4, when the panel runs at 48 Hz, i.e., the power-saving frequency set by the system board section, a perceivable change in brightness may be produced due to increased charging time.

On the contrary, a scheme for driving the panel with PSR On according to the first exemplary embodiment allows the panel to run at i Hz, i.e., a specified operating frequency, rather than an operating frequency set by the system board section. That is, the scheme for driving the panel with PSR On according to the first exemplary embodiment of the present invention is implemented at an operating frequency generated by the circuit board section or a different operating frequency, rather than at the operating frequency set by the system board section.

As explained above, the second control signal generator 134 synchronizes the start point of the internal data enable signal NDE with the start points of the gate start pulse GSP, gate shift clock GSC, gate output enable signal GOE, and source output enable signal SOE included in the second control signal (D-IC control signal 2).

Also, the second control signal generator 134 reduces the pulse widths of the gate start pulse GSP, gate shift clock GSC, gate output enable signal GOE, and source output enable signal SOE included in the second control signal (D-IC control signal 2) so that these signals have a frequency of i Hz, which is higher than 48 Hz.

For example, provided that the panel is normally driven at 60 Hz, as shown in FIG. 9, the operating frequency of the second control signal (D-IC control signal 2) is changed so that the panel, even with PSR On, runs in the same or similar condition as when the panel runs at 60 Hz. Then, the logic high of the gate output enable signal GOE for driving the panel with PSR On starts after the same delay of 3 μs as the logic high of the gate output enable signal GOE for normal driving, and the pulse width of the gate output enable signal GOE becomes 1 μs. That is, the second control signal generator 134 reduces the pulse widths of the gate start pulse GSP, gate shift clock GSC, gate output enable signal GOE, and source output enable signal SOE to be less than reference pulse widths for driving the panel with PSR On, set by the system board section.

After generating the second control signal (D-IC control signal 2) to allow the display panel to run fast at a high operating frequency of i Hz, the second control signal generator 134 leaves the remaining time a blank period (BP).

For instance, as shown in (a) of FIG. 10, the reference frequency for driving the panel with PSR On, set by the system board section, is 48 Hz. However, as shown in (b) of FIG. 10, the second control signal generator 134 generates the second control signal (D-IC control signal 2) at 60 Hz, which is higher than 48 Hz. For 1 frame period, 48 Hz corresponds to 20.84 ms, and 60 Hz corresponds to 16.67 ms. Accordingly, when the panel runs fast at a high operating frequency of i Hz, the remaining time, out of 1 frame period, is 4.17 ms, which corresponds to the blank period (BP).

In the above description, if the panel is normally driven at 60 Hz, i Hz is selected in between 48 Hz and 60 Hz. However, the frequency range of i Hz is not limited to this range since the frequency range for normal driving may vary up to 120 Hz, instead of 60 Hz.

By the way, a vertical blanking interval (VBI) exists between one frame and the next frame. Thus, the addition of the blank period (BP) and the vertical blanking interval (VBI) (see BP+VBI of FIG. 8) makes the vertical blanking interval substantially longer.

The low signal generator 135 generates a logic low signal (LITEST Control Signal_Low) (or a first logic signal) for activating the data driver to operate normally when PSR is turned off. When the logic low signal (LITEST Control Signal_Low) is output from the low signal generator 135, the data driver operates normally.

The high signal generator 136 generates a logic high signal (LITEST Control Signal_High) (or a second logic signal) for deactivating the data driver to be temporarily stopped when PSR is turned on. When the logic high signal (LITEST Control Signal_High) is output from the high signal generator 136, the data driver is temporarily stopped.

Also, the high signal generator 136 operates in conjunction with the second control signal generator 134 to generate the logic high signal (LITEST Control Signal_High). As explained above, the second control signal generator 134 leaves the remaining time blank after the display panel runs fast at a high operating frequency of i Hz.

The high signal generator 136 operates in conjunction with the second control signal generator 134 to generate the logic high signal (LITEST Control Signal_High) to be synchronized with the period between the start of the blank period and the end of the vertical blanking interval. Therefore, when the logic high signal (LITEST Control Signal_High) is output from the high signal generator 136, the data driver stops running for the period of time that equals the sum of the blank period and the vertical blanking interval.

The above description has been made with an example where the low signal generator 135 and the high signal generator 136 are configured as separate blocks. However, the low signal generator 135 and the high signal generator 136 may be integrated together.

The first MUX 137 and the second MUX 138 operate in response to a selection signal output from the frequency control block 132. The first MUX 137 and the second MUX 138 each consist of a 2-input 1-output multiplexer that operates to selectively output one of two signals input in response to the selection signal.

When a selection signal of logic low (L) is output from the frequency control block 132, the first MUX 137 operates to output the first control signal (D-IC Control Signal 1) generated by the first control signal generator 133, and the second MUX 138 operates to output a logic low signal (LITEST Control Signal_Low), i.e., a first logic signal, from the low signal generator 135.

On the other hand, when a selection signal of logic high (H) is output from the frequency control block 132, the first MUX 137 operates to output the second control signal (D-IC Control Signal 2) generated by the second control signal generator 134, and the second MUX 138 operates to output a logic high signal (LITEST Control Signal_High), i.e., a second logic signal, from the high signal generator 136.

With the above-explained configuration of the PSR controller 131, when a PSR On signal is supplied from the system board section, the gate driver and the data driver drive the display panel at a frequency higher than the frequency set by the system board section. Therefore, the problem of perceivable changes in the brightness of the display panel in PSR mode, which occur due to increased charging time caused by a frequency change, can be improved or resolved. Also, the data driver stops driving for the remaining time after operating at a frequency higher than the frequency set by the system board section, thereby cutting down on power use.

As seen from above, the present invention has the advantage of providing a display device and a method of driving the same which can improve or resolve the problem of perceivable changes in brightness in PSR mode and enhance display quality by driving the display panel at a frequency higher than the frequency set by the system board. Moreover, the present invention has the advantage of providing a display device and a method of driving the same which can reduce power consumption in PSR mode by temporarily stopping the data driver for the remaining time after the gate driver and the data driver operate at a frequency higher than the frequency set by the system board section.

Second Exemplary Embodiment

Figure 11:
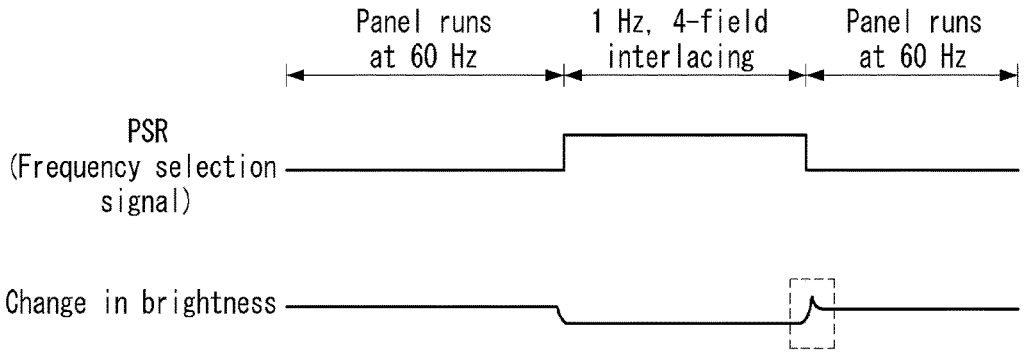
FIG. 11 is a view for explaining a problem involving a combination of interlaced scan and progressive scan during PSR mode according to a test example.
Figure 12:
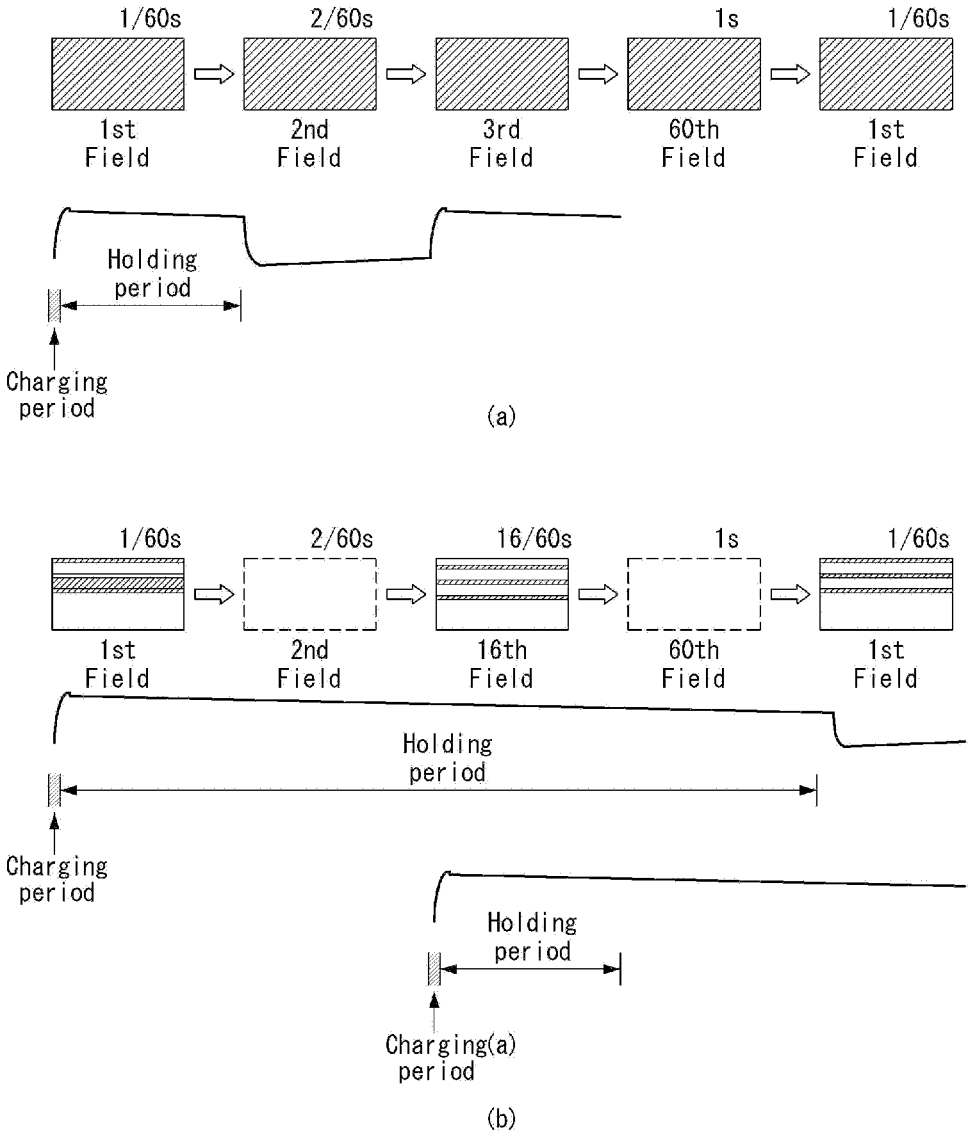
FIG. 12 is a view for explaining charging and holding periods in interlaced and progressive scans according to the test example.
Figure 13:
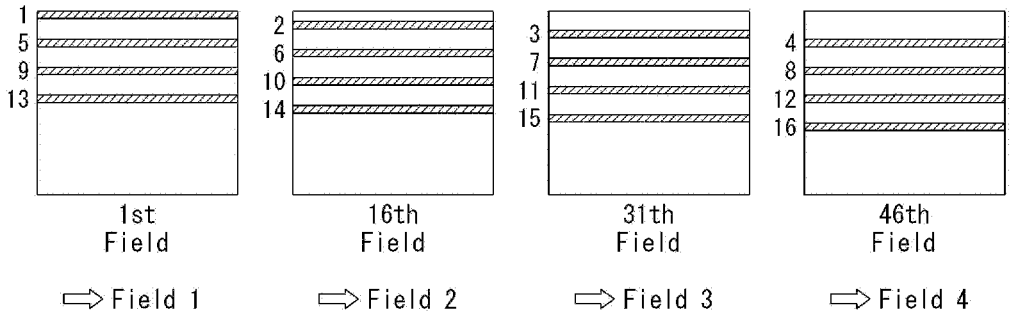
FIG. 13 is a view for explaining an example of how fields are interlaced.
Figure 14:
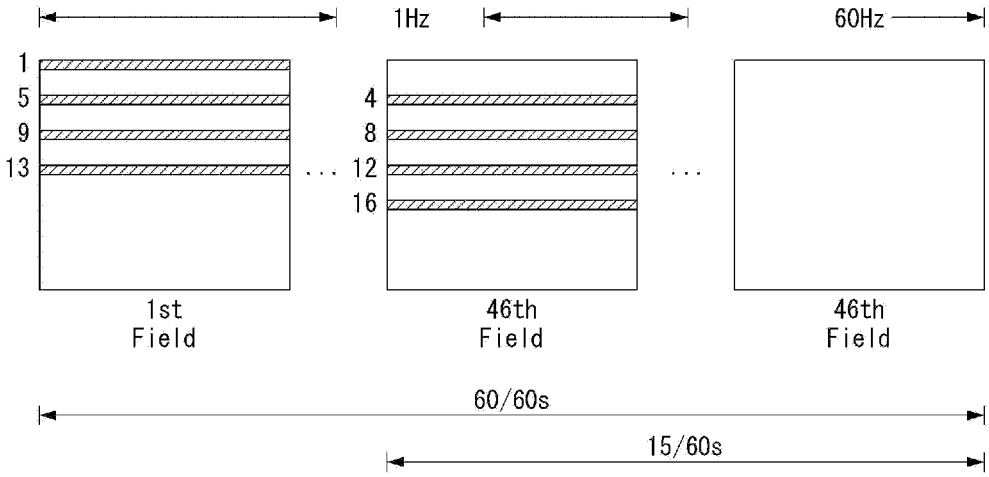
FIG. 14 is a view for explaining differences in voltage fluctuation caused by a frequency change in PSR mode according to the test example.

FIG. 11 is a view for explaining a problem involving a combination of interlaced scan and progressive scan during PSR mode according to a test example. FIG. 12 is a view for explaining charging and holding periods in interlaced and progressive scans according to the test example. FIG. 13 is a view for explaining an example of how fields are interlaced. FIG. 14 is a view for explaining differences in voltage fluctuation caused by a frequency change in PSR mode according to the test example.

By driving the panel in PSR mode as in the first exemplary embodiment of the present invention, the problem of perceivable changes in the brightness of the display panel, which occur due to increased charging time caused by a frequency change, can be improved or resolved. Afterwards, a test was done to enhance the effectiveness of the first exemplary embodiment, in which, when the panel runs at i Hz, an image is divided into m fields (m is an integer equal to or greater than 2) and displayed in an interlaced format, and when the panel runs at 60 Hz, an image is displayed in a progressive format. In this case, i Hz was 1 Hz, which does not fall in between 48 Hz and 60 Hz.

The test example may be an indicator for determining whether interlaced scan and progressive scan can be directly applied when reducing the frequency as much as possible compared to the first exemplary embodiment and switching the scanning method between interlaced scan and progressive scan, and also helps understand any problems involving PSR mode.

However, when the frequency was reduced and the scanning method was switched from a 1 Hz interlaced scan to a 60 Hz progressive scan, in response to a PSR signal, flicker (see the dotted rectangular box) was seen due to differences in the charging and holding periods between each field, as shown in FIG. 11, due to the characteristics of interlaced scanning.

Hereinafter, charging and holding periods in interlaced and progressive scans will be described in more detail. It should be noted that, though the frequency used in interlaced scan is 1 Hz, which is the same frequency as the test example, it is merely an example and also may include any frequency falling in between 1 Hz and 48 Hz.

As shown in (a) of FIG. 12, the 60 Hz progressive scan allows 60 image frames input from the system board section for 1 second to be displayed (in other words, charged) on the display panel every 1/60 second. Due to this, the charging period and the holding period occur every other field in a total of 60 fields.

As shown in (b) of FIG. 12, the 1 Hz interlaced scan allows an image broken up into 4 to be displayed on the display panel four times (1th, 16th, 31th, and 46th fields) per second. Due to this, the charging period and the holding period occur every 15 fields in a total of 60 fields. In the 1 Hz interlaced scan, each image contains four fields.

As shown in FIG. 14, the point in time when the scanning method is switched from the 1 Hz interlaced scan to the 60 Hz progressive scan, in response to a PSR signal, will be discussed below. For the first field positioned at the beginning of the 1 Hz interlaced scan, the voltage is charged in 1/60 of a second, held in the capacitor for 60/60 of the second, and then charged again. In contrast, for the 46th field, i.e., the last field, positioned at the end of the 1 Hz interlaced scan, the voltage is held in the capacitor for 15/60 of the second, and then charged again.

In other words, in the 1 Hz interlaced scan, each field shows different voltage fluctuations when charged (the differences in voltage fluctuation are in the following order: Field 1>Field 2>Field 3>Field 4). As such, the largest difference in voltage fluctuation between each field is observed during the period of transition to the 60 Hz progressive scan, thus producing flicker.

In the present invention, in order to reduce power consumption, the panel runs at a low frequency (e.g., 1 Hz) for a static image, whereas the panel runs at a high frequency (e.g., 60 Hz) for a moving image. However, the combined use of progressive scan and interlaced scan leads to flicker during the transition period when the frequency changes significantly, which will be improved as follows.

Figure 15:
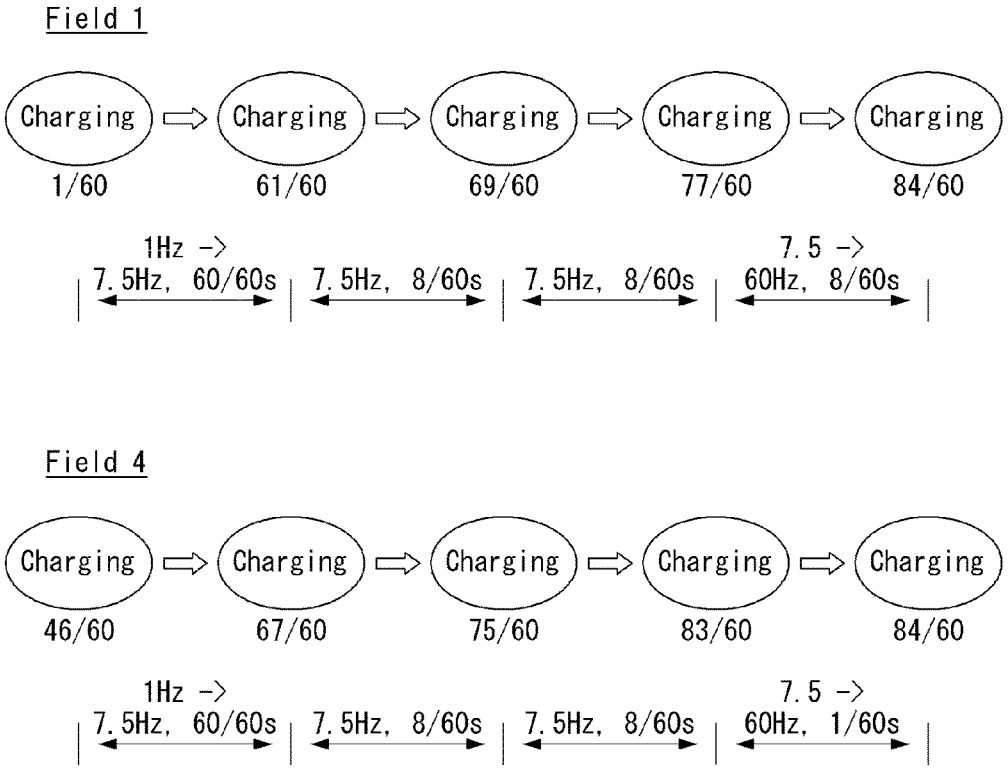
FIG. 15 is a flowchart of a frequency change, for explaining a PSR scheme according to a second exemplary embodiment of the present invention.
Figure 16:
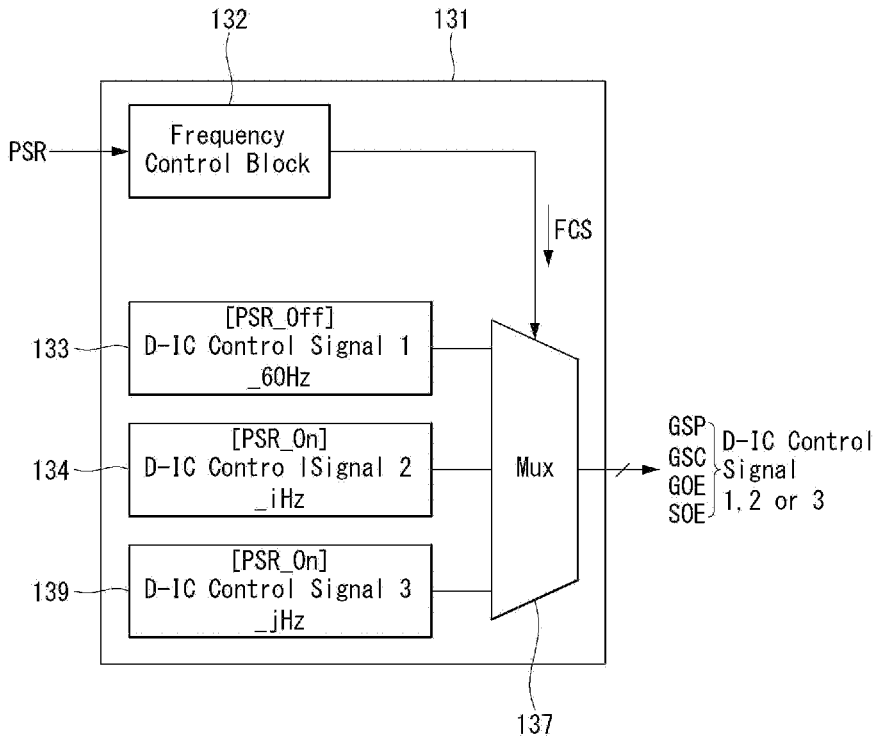
FIG. 16 is a block diagram of a PSR controller for realizing the second exemplary embodiment of the present invention.
Figure 17:
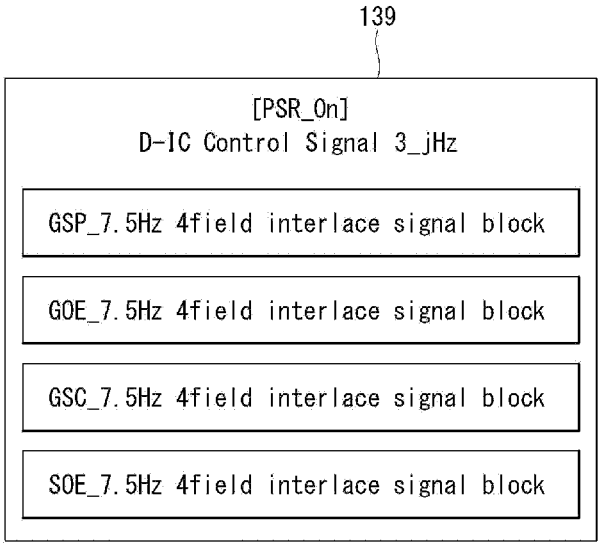
FIG. 17 is a view showing another part of the PSR controller of FIG. 16.
Figure 18:
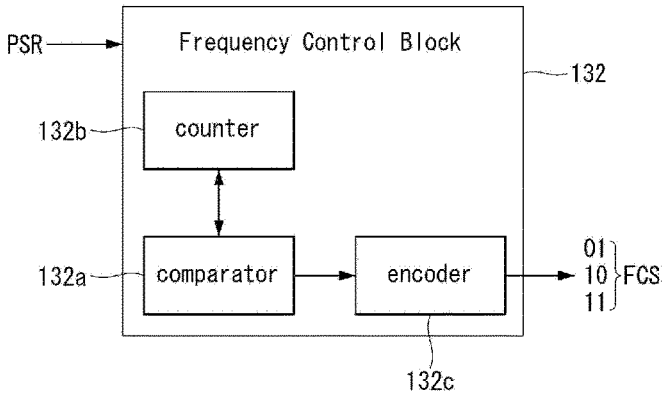
FIG. 18 is a view showing the frequency control block of FIG. 16.

FIG. 15 is a flowchart of a frequency change, for explaining a PSR scheme according to a second exemplary embodiment of the present invention. FIG. 16 is a block diagram of a PSR controller for realizing the second exemplary embodiment of the present invention. FIG. 17 is a view showing another part of the PSR controller of FIG. 16. FIG. 18 is a view showing the frequency control block of FIG. 16.

In the PSR scheme according to the second exemplary embodiment of the present invention, as is with the first exemplary embodiment, if an input data signal is for a static image, PSR is enabled. With PSR enabled, the system board section is powered down, and some components of the system board section stop running and go to a sleep state. When the image processor, etc. of the system board section goes to a sleep state, the timing controller of the circuit board section receives the previously received data signal from the remote frame memory, but the present invention is not limited by this.

The PSR controller included in the timing controller of the circuit board section changes the operating frequency of the gate driver and data driver, and temporarily stops (or interrupts) the data driver only for a specific period.

When the operating frequency of the gate driver and data driver is changed from 1 Hz to 60 Hz, the PSR controller according to the second exemplary embodiment of the present invention inserts compensation fields (or a compensation frequency) into the transition period between these two frequencies, in order to improve and resolve problems involving the frequency deviation.

As shown in FIG. 15, four fields (compensation fields) with a frequency of 7.5 Hz are output for a predetermined period of time during the transition period from a 1 Hz interlaced scan to a 60 Hz progressive scan. As a consequence, the differences in holding period between the first to four fields Field 1 to Field 4 were reduced, causing no perceivable flicker.

As can be seen from FIG. 15, in the second exemplary embodiment of the present invention, there exists an intermediate phase corresponding to the four compensation fields with the 7.5 Hz frequency during the transition period from the 1 Hz interlaced scan to the 60 Hz progressive scan.

When the scanning method was switched from the 1 Hz interlaced scan to the 60 Hz progressive scan, as is with the test example, no flicker was perceived when the four fields (compensation fields) with the 7.5 Hz frequency were output for a predetermined period of time during the transition period.

As such, it can be said that the second exemplary embodiment was given only to define compensation fields as four fields with the 7.5 Hz frequency, based on the test example. Accordingly, it will be obvious to those skilled in the art, that if other frequencies than 1 Hz and 60 Hz are used in interlaced scan and progressive scan, a different number of fields with a different frequency, rather than 4 fields with the 7.5 Hz frequency, may be created. Hereinafter, m-field interlacing with a frequency of i or j Hz will be referred to as i or j Hz 4-field interlacing.

As shown in FIG. 16, the PSR controller 131 outputs a D-IC control signal for changing the operating frequency of the gate driver and data driver, in association with the turn-on/off of PSR.

Although not shown, the PSR controller 131 of the second exemplary embodiment also may output a logic signal LITEST for temporarily stopping the data driver only for a specific period, like the PSR controller 131 (shown in FIG. 5) does. In this case, the PSR controller 131 of the second exemplary embodiment further comprises a low signal generator 135, a high signal generator 136, and a second MUX 138.

The PSR controller 131 comprises a frequency control block 132, a first control signal generator 133, a second control signal generator 134, a third control signal generator 139, and a first MUX 137.

The frequency control block 132 outputs a selection signal for controlling an operating frequency output from the timing controller, depending on the state of a PSR signal. When a PSR Off signal is supplied, the frequency control block 132 outputs a first selection signal to output a signal associated with the turn-off of PSR. In contrast, when a PSR On signal is supplied, the frequency control block 132 outputs second and third selection signals to output a signal associated with the turn-on of PSR.

The first control signal generator 133 generates a first control signal (D-IC control signal 1) for controlling the operating frequency of the gate driver and data driver when PSR is turned off. For example, the first control signal generator 133 generates a gate start pulse GSP, gate shift clock GSC, and gate output enable signal GOE for controlling the operating frequency of the gate driver, and a source output enable signal SOE for controlling the operating frequency of the source driver.

The first control signal (D-IC control signal 1) output from the first control signal generator 133 has a frequency for driving the display panel with PSR Off (or normal mode). For example, if a normal operating frequency for the display panel is represented by 60 Hz, the first control signal generator 133 generates the gate start pulse GSP, gate shift clock GSC, gate output enable signal GOE, and source output enable signal SOE included in the first control signal (D-IC control signal 1), corresponding to 60 Hz.

The second control signal generator 134 generates a second control signal (D-IC control signal 2) for controlling the operating frequency of the gate driver and data driver when PSR is turned on. For example, the second control signal generator 134 generates a gate start pulse GSP, gate shift clock GSC, and gate output enable signal GOE for controlling the operating frequency of the gate driver, and a source output enable signal SOE for controlling the operating frequency of the source driver.

The second control signal (D-IC control signal 2) output from the second control signal generator 134 has a frequency for driving the display panel with PSR On (or power-saving mode). As shown in FIG. 7, the timing controller delays the data enable signal supplied from the image processor by 1 horizontal period (1H) or longer to generate an internal data enable signal NDE.

Due to this, the second control signal generator 134 of the PSR controller 131 included in the timing controller generates the second control signal (D-IC control signal 2) based on the internal data enable signal NDE. As shown in FIG. 8, the second control signal generator 134 changes the second control signal (D-IC control signal 2) based on the internal data enable signal NDE to have a frequency of i Hz (i Hz is a frequency equal to or higher than 1 Hz).

The third control signal generator 139 generates a third control signal (D-IC control signal 3) for controlling the operating frequency of the gate driver and data driver when PSR is turned on. For example, as shown in FIG. 17, the third control signal generator 139 generates a gate start pulse GSP, gate shift clock GSC, and gate output enable signal GOE for controlling the operating frequency of the gate driver, and a source output enable signal SOE for controlling the operating frequency of the source driver.

The third control signal (D-IC control signal 3) output from the third control signal generator 139 has a frequency for compensating for a transition period when the display panel is driven with PSR On (or power-saving mode). The third control signal generator 139 changes the third control signal (D-IC control signal 3) based on the internal data enable signal NDE to have a frequency of j Hz (j Hz is a frequency higher than i Hz and lower than 60 Hz). The third control signal generator 139 generates a gate start pulse GSP, gate shift clock GSC, gate output enable signal GOE, and source output enable signal SOE by 7.5 Hz, 4-field interlacing, for example.

As shown in FIG. 18, the frequency control block 132 outputs a selection signal for controlling an operating frequency output from the timing controller, depending on the state of a PSR signal.

The frequency control block 132 comprises a comparator 132*a*, a counter 132*b*, and an encoder 132*c*. The comparator 132*a* serves to determine the state of a PSR signal (a change in PSR signal). The counter 132*b* operates in conjunction with the comparator 132*a*, and serves to count the elapsed time when there is a change in PSR signal and converts the frequency after the elapse of a given period of time to insert compensation fields into the transition period. The encoder 132*c* operates in conjunction with the comparator 132*a* and the counter 132*b*, and outputs a selection signal FCS.

For instance, when a first selection signal (FCS, 01) is output form the frequency control block 132, the first control signal generator 133 generates a gate start pulse GSP, gate shift clock GSC, gate output enable signal GOE, and source output enable signal SOE by 60 Hz progressive scanning.

For instance, when a second selection signal (FCS, 10) is output form the frequency control block 132, the second control signal generator 134 generates a gate start pulse GSP, gate shift clock GSC, gate output enable signal GOE, and source output enable signal SOE by 1 Hz, 4-field interlacing.

For instance, when a third selection signal (FCS, 11) is output form the frequency control block 132, the third control signal generator 139 generates a gate start pulse GSP, gate shift clock GSC, gate output enable signal GOE, and source output enable signal SOE by 7.5 Hz, 4-field interlacing.

In this way, the PSR controller improves flicker by inserting a compensation frequency of j Hz (j is an integer higher than i and lower than k) into a transition period situated between a frequency of i Hz and a frequency of k Hz.

Figure 19:
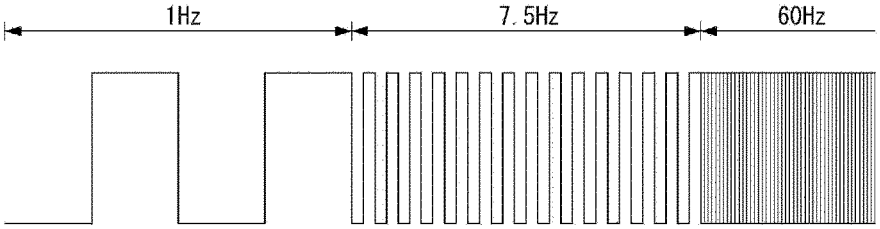
FIG. 19 is a waveform diagram showing a polarity signal to which the second exemplary embodiment of the present invention is applied.
Figure 20:
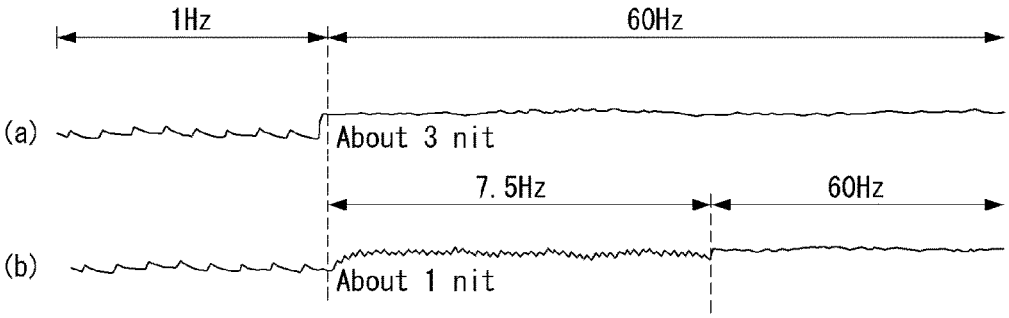
FIG. 20 is a waveform diagram showing optical measurements performed on a display device to which the second exemplary embodiment of the present invention is applied.

FIG. 19 is a waveform diagram showing a polarity signal to which the second exemplary embodiment of the present invention is applied, and FIG. 20 is a waveform diagram showing optical measurements performed on a display device to which the second exemplary embodiment of the present invention is applied.

FIG. 19 depicts a polarity signal from which it can be seen that the PSR controller 131 detects a PSR signal and adds a frequency of 7.5 Hz in the period of operating frequency transition from 1 Hz, 4-field interlacing to 60 Hz progressive scanning.

As shown in (a) of FIG. 20, the test example showed a brightness change of about 3 nit (perceivable level of flicker) in the period of operating frequency transition from 1 Hz, 4-field interlacing to 60 Hz progressive scanning because there were large differences in voltage fluctuation between each field.

In contrast, as shown in (b) of FIG. 20, the second exemplary embodiment showed a brightness change of about 1 nit (unperceivable level of flicker) in the period of operating frequency transition from 1 Hz, 4-field interlacing to 60 Hz progressive scanning because the differences in voltage fluctuation between each field were reduced by inserting compensation fields.

The second exemplary embodiment of the present invention improves flicker by inserting compensation fields (or a compensation frequency) during a given period of time corresponding to the transition from 1 Hz, 4-field interlacing to 60 Hz progressive scanning.

While the second exemplary embodiment of the present invention has been described by taking the transition from 1 Hz, 4-field interlacing to 60 Hz progressive scanning as an example, the present invention may be applied the other way around, which is to say, to the period of operating frequency transition from 60 Hz, progressive scanning to 1 Hz, 4-field interlacing.

The second exemplary embodiment of the present invention has been described only in terms of frequency by taking the transition of the operating frequency from 1 Hz to 7.5 Hz to 60 Hz as an example. However, the second exemplary embodiment may be designed in a way that multiple frequencies are inserted, i.e., the operating frequency gradually changes like 1 Hz→5 Hz→7.5 Hz→15 Hz→Hz→60 Hz, to minimize perceivable changes in brightness. In this case, the operating frequency varies seamlessly (or smoothly), and therefore perceivable changes in brightness can be further improved.

Although the foregoing description has been made separately of the first and second exemplary embodiments, a display device capable of coping with various operating environments and driving methods can be realized by combining the PSR controllers of the first and second exemplary embodiments together. Therefore, the problem of perceivable changes in brightness can be improved or resolved, and display quality can be further enhanced.

As seen from above, the second exemplary embodiment of the present invention has the advantage of providing a display device which is capable of improving flicker that occurs in the period of operating frequency transition in PSR mode, and a method of driving the same.

What is claimed is:

1. A display device comprising:

a system board section;

an interface coupled to the system board section; and a circuit board section communicating to the system board section via the interface, the circuit board section comprising a Panel Self Refresh (PSR) controller that, responsive to receiving a PSR On signal from the system board section, changes an operating frequency of a gate driver and a data driver to a frequency higher than a reference frequency during a frame period other than a blank period, the reference frequency indicating a frequency at which a panel is refreshed when the PSR On signal is received.

2. The display device of claim 1, wherein, when the PSR On signal is supplied from the system board section, the PSR controller stops the data driver for a given period of time.

3. The display device of claim 1, wherein the PSR controller is incorporated in a timing controller that controls the gate driver and the data driver, the PSR controller synchronizes a start point of an internal data enable signal generated by the timing controller with start points of a gate start pulse, a gate shift clock, a gate output enable signal, and a source output enable signal, and reduces pulse widths of the gate start pulse, the gate shift clock, the gate output enable signal, and the source output enable signal to be shorter than reference pulse widths for driving the panel with a PSR turned on, set by the system board section.

4. The display device of claim 3, wherein the PSR controller stops the data driver during the blank period.

5. The display device of claim 4, wherein the data driver is stopped during a period of time corresponding to a sum of a vertical blanking interval and the blank period.

6. The display device of claim 1, wherein the PSR controller comprises:

a frequency control block that outputs a selection signal in response to a PSR signal supplied form the system board section;

a first control signal generator that generates a first control signal for controlling the operating frequency of the gate driver and data driver when a PSR is turned off;

a second control signal generator that generates a second control signal for controlling the operating frequency of the gate driver and data driver when the PSR is turned on; and a first MUX that outputs either the first control signal or the second control signal in response to the selection signal.

7. The display device of claim 6, wherein the second control signal generator synchronizes a start point of an internal data enable signal generated by a timing controller with start points of a gate start pulse, a gate shift clock, a gate output enable signal, and a source output enable signal included in the second control signal, and reduces pulse widths of the gate start pulse, the gate shift clock, the gate output enable signal, and the source output enable signal to be shorter than reference pulse widths for driving the panel with the PSR turned on, set by the system board section.

8. The display device of claim 7, wherein the PSR controller comprises:

a low signal generator that generates a first logic signal for activating the data driver when the PSR is turned off;

a high signal generator that generates a second logic signal for deactivating the data driver when the PSR is turned on; and a second MUX that selectively outputs either the first logic signal or the second logic signal in response to the selection signal.

9. The display device of claim 1, wherein, when the PSR On signal is supplied from the system board section, the circuit board section changes the operating frequency of the gate driver and data driver to i Hz (where i is an integer equal to or higher than 1), corresponding to an operating frequency generated by the circuit board, rather than the operating frequency set by the system board section.

10. The display device of claim 9, wherein, when the display panel normally runs at 60 Hz, the circuit board section selects i Hz between 48 Hz and 60 Hz.

11. A method of driving a display device that transmits signals between a system board section and a circuit board section through an interface and uses Panel Self-Refresh (PSR) to reduce power consumption, the method comprising:

responsive to receiving a PSR On signal from the system board section, changing an operating frequency of a gate driver and a data driver to a frequency higher than a reference frequency during a frame period other than a blank period, the reference frequency indicating a frequency at which a panel is refreshed when the PSR On signal is received; and temporarily stopping the data driver during a period of time corresponding to a sum of a vertical blanking interval and the blank period.

12. The method of claim 11, wherein, in the changing of the operating frequency of the gate driver and data driver, a start point of an internal data enable signal generated by a timing controller is synchronized with start points of a gate start pulse, a gate shift clock, a gate output enable signal, and a source output enable signal, and pulse widths of the gate start pulse, the gate shift clock, the gate output enable signal, and the source output enable signal are reduced to be shorter than reference pulse widths for driving the panel with a PSR turned on, set by the system board section.

13. A display device comprising:

a system board section;

an interface coupled to the system board section; and a circuit board section communicating to the system board section via the interface, the circuit board section comprising a Panel Self Refresh (PSR controller that, responsive to receiving a PSR On signal from the system board section to change an operating frequency of a gate driver and a data driver from a frequency of k Hz where k is an integer equal to or higher than 60 to a frequency of i Hz where i is an integer equal to or higher than 1, inserts a compensation frequency of j Hz where j is an integer higher than i and lower than k into a transition period situated between the i Hz frequency and the k Hz frequency.

14. The display device of claim 13, wherein the PSR controller inserts multiple compensation frequencies into the transition period situated between the frequency of i Hz and the frequency of k Hz in such a way that the operating frequency gradually changes.

15. The display device of claim 13, wherein, when the PSR On signal is supplied from the system board section, the circuit board section gradually changes the operating frequency of the gate driver and data driver from the i Hz frequency to the k Hz frequency, corresponding to an operating frequency generated by the circuit board section, rather than the operating frequency set by the system board section.

16. The display device of claim 15, wherein, when the display panel normally runs at 60 Hz, the circuit board section changes the frequency from i Hz to k Hz in an order of 1 Hz, 7.5 Hz and 60 Hz.

17. The display device of claim 15, wherein, when the display panel normally runs at 60 Hz, the circuit board section changes the frequency from i Hz to k Hz in an order of 1 Hz, 5 Hz, 7.5 Hz, 15 Hz, 30 Hz and 60 Hz.

* * * * *